United States Patent [19]

Robertson

[11] Patent Number: 4,898,747

[45] Date of Patent: Feb. 6, 1990

[54] ELECTROSTATIC COATING OF RUBBER-TO-METAL ADHESIVES ON METAL PARTS

[75] Inventor: Kenneth L. Robertson, Ottawa Hills, Ohio

[73] Assignee: Ken-Koat, Inc., Delta, Ohio

[21] Appl. No.: 274,118

[22] Filed: Nov. 21, 1988

Related U.S. Application Data

[63] Continuation of Ser. No. 178,804, Mar. 29, 1988, Pat. No. 4,810,521, which is a continuation of Ser. No. 885,623, Jul. 15, 1986, abandoned.

[51] Int. Cl.[4] ..... B05D 1/04; B05D 1/06; B05D 3/02; B05D 5/00

[52] U.S. Cl. ..... 427/31; 427/379; 427/388.1; 427/409

[58] Field of Search ..... 427/27, 30, 31, 379, 427/388.1, 409

[56] References Cited

U.S. PATENT DOCUMENTS

| | | | |
|---|---|---|---|
| 2,893,894 | 7/1959 | Ransburg | 117/93 |
| 3,475,198 | 10/1969 | Drum | 118/626 X |
| 3,649,408 | 3/1972 | Miller | 156/272 |
| 4,243,705 | 1/1981 | Yapp et al. | 427/386 |
| 4,296,708 | 10/1981 | Robertson et al. | 118/233 |
| 4,547,410 | 10/1985 | Panush et al. | 427/388.2 |
| 4,647,309 | 3/1987 | Hayner | 427/27 X |

OTHER PUBLICATIONS

"Finishing Equipment and Systems", brochure (undated), Ransburg Corporation, Indianapolis, IN.

*Primary Examiner*—Michael Lusignan
*Attorney, Agent, or Firm*—Biebel, French & Nauman

[57] ABSTRACT

A method for applying rubber-to-metal adhesives to metal parts, such as tubular metal sleeves, employs electrostatic disc-type coaters includes the employment slow solvents which maintain the adhesive in a wet or liquid condition from its atomization at the disc to its deposition on the parts. The adhesives are diluted with a solvent which contains cyclohexanone and petroleum solvents.

7 Claims, 1 Drawing Sheet

ELECTROSTATIC COATING OF RUBBER-TO-METAL ADHESIVES ON METAL PARTS

CROSS REFERENCE TO RELATED APPLICATIONS

The present application is a continuation of application Ser. No. 178,804, filed Mar. 29, 1988, now U.S. Pat. No, 4,810,521, which, in turn, is a continuation of application Ser. No. 885,623, filed July 15, 1986, abandoned.

BACKGROUND OF THE INVENTION

In the automotive industry, rubber-coated metal parts are in widespread use. Such parts may be found in shock absorber bushings, engine mounts, or other applications where it is necessary or desirable to bond a natural or synthetic rubber to a metal substrate, often a tubular piece of metal.

By reason of the poor bonding which is obtained with straight rubber-to-metal bonds, adhesives are used which are first applied to the metal part, and thereafter forms a bond to the rubber part. Such adhesives may become cured in the same vulcanizing step in which the rubber is vulcanized and are known as post vulcanizing or PV bonding. However, pre-vulcanizing bonding materials may also be employed.

One method of applying such coating material to the parts in question has been that of conventional spray coating, while rotating the part, to form a coating of the bonding material on the outer surface. The spray coated part may the be heated to drive off the solvent. This process is inefficient in that only about 30 percent of the total adhesive sprayed is deposited on the part, and the remaining 70 percent is lost or can be recovered only with great difficulty. Dip coating also is found to have drawbacks and is inefficient in that the entire part is coated, with the coating running into the center openings or the like where it is not desired. Further dip coating may cause excessive buildup of material on the edges of the parts when the part is withdrawn from the solution, and some excess material can contribute to bond failure between the rubber and the metal at a later time.

In the patent of Robertson et al., U.S. Pat. No. 4,296,708 issued Oct. 27, 1981 and assigned to the same assignee as this invention, there is described and claimed a roll coating apparatus which has been employed to coat hollow metal sleeves or other metal parts. However, while the apparatus as disclosed and claimed in the Robertson et al patent has been successfully operated, the apparatus does not lends itself to high volume production rates, and further, the coating apparatus employed required extensive cleanup at the end of each production run and required monitoring to prevent undesired buildup of the coating material. There accordingly exists a need for a more efficient method and apparatus of applying rubber-to-metal bonding materials to rubber parts, such as hollow metal sleeves and the like.

SUMMARY OF THE INVENTION

This invention relates to the coating of metal, such as tubular metal parts, with adhesive bonding materials to provide for the bonding of natural and synthetic rubbers thereto, or for the priming of such metal parts with an adhesive primer for a subsequent application of a bonding material, and includes the employment of electrostatic disc coating apparatus in such coating processes.

Electrostatic disc atomization of paint and other materials has been employed by pumping the paint to an atomizer disc which spins to cause the paint to spread out to the atomizing edge. The paint is then atomized under the influence of an electrostatic field, where it receives a charge, such as a negative charge, and is repelled away from the atomizer. The atomized mist is then attracted toward the grounded workpiece. Disc-type atomization has not been successfully used, to applicant's knowledge, for the application of such undercoat adhesives for the bonding of natural or synthetic rubbers to metal, primarily by reason of the fact that such adhesives, when used with the recommended solvents, and mixed to the desired viscosity, do not lend themselves to electrostatic application. Generally, the solvents or diluents are too fast, and the material reaches the grounded metal parts in a dried or semi-dried state, and good coating is not achieved. Also, some of the adhesives are non-polar or have low polarity and are not carried well by the electrostatic charge.

It has been discovered that rubber-to-metal bonding agents may be successfully electrostatically applied by a disc applicator where certain slower solvents are substituted for the recommended diluents or solvents, to ensure that a wet film is applied to the substrate, and where the solvent has been modified to raise the polarity of the adhesive.

The principal bonding materials employed in this invention in the adhesive bonding of elastomers to metal comprise a 200-series family of rubber-to-metal adhesive and adhesive primers made by Lord Chemical Products (formerly Hughson Chemical Company) of Erie, Pa. under the "Chemlok" trademark. These include Chemlok 205 as a primer, Chemlok 220, 220E and 233 as high strength bonding agents over the 205 primer, and Chemlock 250, 252, 253 and 257 as single coat adhesives without primer. Additionally, Thixon OSN-2, P-6-1, P-10 and 508 may be applied to pre-primed metal and are available from the Dayton Chemicals Division, Whittaker Corporation, West Alexandria, Ohio. The noted "Chemlok" and "Thixon" materials are low solids adhesives. The noted "Chemlok" adhesives have solids contents ranging by weight within the range of about 19–26 wt. % and the noted "Thixon" products have solids contents ranging from about 14–26 wt. %. "Low solids" means having less than about 40 percent by weight solids content.

Such adhesives as described above are normally diluted with toluene, xylene, MEK or methyl isobutyl ketone. Such compounds as identified and as conventionally employed for the priming and coating of metal articles for rubber bonding, such as was used in the above-identified patent of Robertson et al., have not been successfully spray coated from disc-type electrostatic coaters. The present invention employs the use of such basic coatings materials and a diluent or solvent consisting primarily of cyclohexanone and petroleum solvents, with a small amount of methyl ethyl ketone added, in a ratio of approximately 1 part of adhesive to 1 part of such solvent. Such slower solvents have been found to be compatible with electrostatic application and ensure that a wet film is applied to the substrate. They permit such adhesive materials to be successfully electrostatically atomized from a disc atomizer and applied to stacks of metal parts such as tubes and sleeves, carried on grounding rods by a conveyor. Preferably, the materials are applied in two passes, on a continuous conveyor, using a pair of disc-type electrostatic applicators and a double pass oven between the applicators.

It is accordingly an important object of this invention to provide a method of coating metal parts with an adhesive coating, utilizing electrostatic atomization.

Another object is the provision of a process of applying adhesive coating to parts employing relatively slow solvents or diluents to maintain the atomized adhesive in a wet condition during its transportation from an atomizing disc to a grounded support or workpiece.

Another object of the invention is the provision of a process of electrostatically coating metal objects, such as metal sleeves, with rubber-to-metal elastomer in an electrostatic disc-type coater.

A further object of the invention is that of a method or process for the coating of cylindrical metal elements with an rubber-to-metal adhesive including the steps of electrostatically coating a base material, which material has been diluted with a retarding or slow solvent, curing the coated material, followed by the electrostatic coating of a second material, which material has also been retarded as the first material, followed by curing of the second material. More particularly, it is an object of the invention to heat such materials to decrease their viscosity and enhance their coatability in a disc-type electrostatic coater.

DESCRIPTION OF PREFERRED EMBODIMENT

Figure 1:
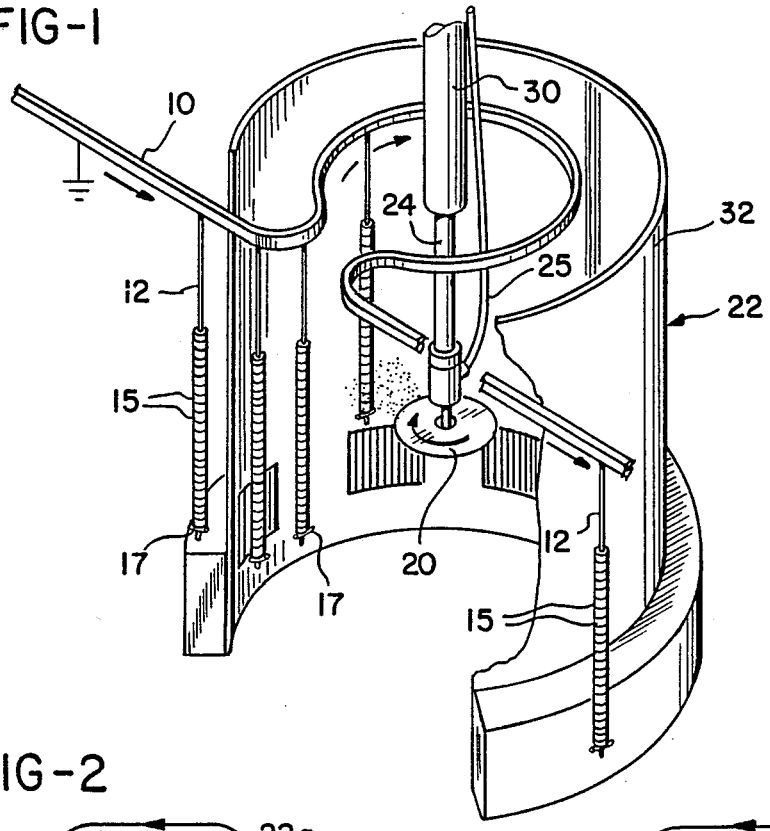
FIG. 1 is a somewhat diagrammatic and broken away view of a portion of the process of this invention, showing the conveying for conveying stacks of tubular elements for the application of adhesive in a disc-type electrostatic coater.
Figure 3:
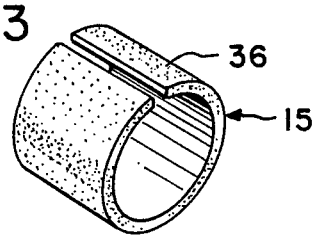
FIG. 3 is a perspective view of a part which has been coated with adhesive according to the process of this invention.

Referring first to FIG. 1, a conveyor 10, which is grounded, is shown as supporting a plurality of depending wire rods 12 therefrom, on which have been stacked in end-to-end abutting relation a plurality of workpieces 15 in the form of tubular metal sleeves. FIG. 3 shows a perspective view of one of such sleeves, which may form the inside bushing of the eye of a shock absorber and have bonded to its outer surface a quantity of natural or synthetic rubber. The sleeves 15 are held in such stacked relation on the depending rods by a bottom keeper key or pin 17.

The conveyor 10 is shown as passing about an applicator disc 20 of an electrostatic disc-type applicator 22. The disc 20 is mounted for rotation by a motor 23 on a rod or shaft 24. A supply of diluted adhesive (not shown) is delivered through a pipe 25 to the disc 20 for application to the surface of the disc.

In accordance with known technology, such as shown in the U.S. Pat. No. of Miller, 3,649,408 of Mar. 14, 1972, a direct current supply (not shown) is attached to apply a suitable potential to the disc 20, such as a negative potential of between 72,000 and 78,000 volts. The disc 22 is reciprocated on an insulating shaft 24, such as by a piston motor 30 and is slowly moved up and down with relation to the rods, in the housing 32 for the purpose of evenly distributing the elastomer material which is being atomized off of the circumference of the disc. As an example, the disc 20 may be fifteen inches in diameter and be driven at a rate of 1,800 rpm.

Figure 2:
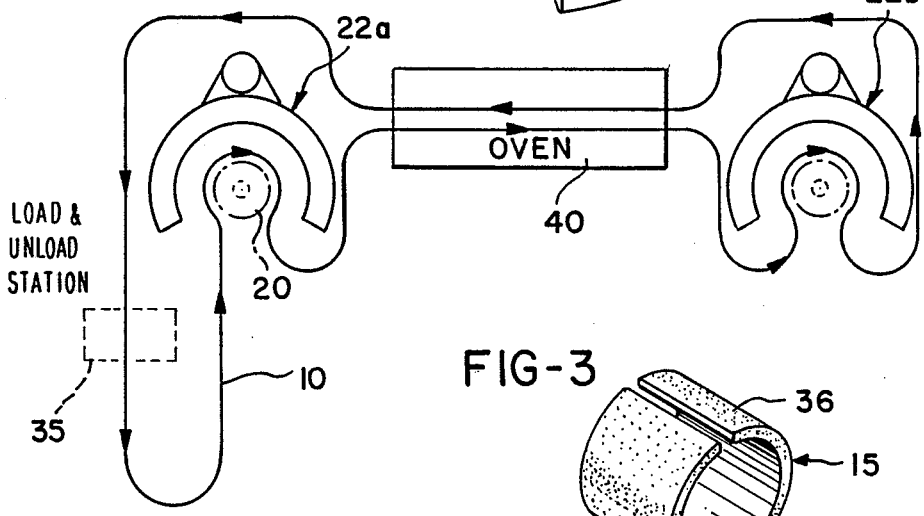
FIG. 2 is a flow diagram showing the manner in which the parts are carried to two electrostatic coaters on a continuous conveyor through a double pass oven.

Preferably, a pair of disc-type electrostatic applicators 22 are employed, such as the applicators **22*a* and 22*b* as diagramatically illustrated in FIG. 2. The conveyor 10 is a continuous or closed loop conveyor leading past a loading station 35, at which point the rods 12 and assembled workpieces 15 are loaded onto the conveyor for passage through a first disc-type applicator 22. The applicator 22*a* may apply a priming adhesive coat such as the material previously identified above as Chemlok 205. The electrostatic field results in the coating being uniformly applied to the outer surface of the grounded workpieces, such as the coating represented by the reference numeral 36 in FIG. 3, with very little if any coating forming on the interior. The support rods 12 may be rotated as they are carried by the conveyor 10** so that all sides of the sleeves are exposed for coating.

The thus coated sleeves 15 on the rods 12 are delivered in a first pass through one side of a double pass oven 40 for initial curing. The oven 40 is preferably operating at a temperature of approximately 150° F., and the coating, in accordance with this invention, is cured in approximately three minutes. The now somewhat heated workpieces are delivered to the second disc-type electrostatic coater **22*b*, where the second or final adhesive coating is applied. After the application of such coating, by reason of the passage of the depending rods 12 and stacked workpieces thereon about the disc 20, the conveyor 10 exits and follows a second pass through the oven 40 for curing of the second coat. The second coat is enhanced in its curing by reason of the preheating which had been applied to the pieces following the first application of coating material. Upon leaving the oven 40, the pieces are returned to the station 35** for removal.

A particular improvement in the process of the present invention resides in the employment of an especially formualted diluent or solvent in place of the recommended solvents for each of rubber-to-metal adhesives applied by the applicators **22*a* and 22*b***. It has been found that a solvent which contains, as its principal constituents, cyclohexanone and petroleum solvents, is particularly effective in maintaining the desired wetness of the atomized adhesive while still permitting the desired dilution and viscosity. For example, one part of adhesive is mixed with about one to 1.25 parts of solvent. The solvent is added to obtain an average viscosity of between 22 and 26 seconds in a No. 2 Zahn cup, at room temperature.

The solvent may be formulated as follows:

4 parts cyclohexanone
2 parts SC150 (a heavy aromatic naphthalene petroleum based solvent consisting primarily of C10 hydrocarbon and 9% naphthalene by mass)
2 parts SC100 (a light aromatic naptha petroleum based solvent consisting primarily of C9 aromatic hydrocarbon and containing 5% xylene by mass, of Exxon Corporation)
1 part methyl ethyl ketone (MEK)

The solvent as identified above raises the polarity of the adhesive, thus optimizing the efficiency of atomization with the optimum polarity being between 0.3 and 0.5 megohms achieved by the addition of the cyclohexanone and MEK. About one part of solvent is mixed with one part of adhesive, in lieu of the diluents or solvents conventionally employed, to provide a sufficiently low viscosity and slow drying rate.

The general rule in formulating the solvent mix identified above it not to add any more SC150 petroleum based solvent than is necessary. If an excess of SC150 is used, the evaporation rate can be slowed down to the point where the subsequent drying of the coating may prove to be more difficult, and unevaporated solvent in the coating could present problems with the subsequent elastomer molding operation. While the favorable slow evaporation rate of the SC150 component is particularly useful in enabling the delivery of a wet adhesive to the parts, it is a general rule not to add any more of this component than necessary to assure such wet delivery and wet coating qualities. It is also within the scope of this invention, if required, to preheat the adhesive mix prior to application of the disc, and thus the diluted adhesive may be preheated such as to 110°-130° F. by a heater and a recirculating pump, for each of the solvent supplies associated with the applicators 22*a* and 22*b*. Heating may be useful in some instances to adjust the viscosity.

While the process herein described constitutes a preferred embodiment of this invention, it is to be understood that the invention is not limited to this precise process, and that changes may be made therein without departing from the scope of the invention which is defined in the appended claims.

What is claimed is:

1. The process of treating metal parts for bonding of rubber thereto by the application of a rubber-to-metal adhesive thereon, comprising the steps of providing a plurality of metal parts, conveying said parts through a disc-type electrostatic applicator while applying a first rubber-to-metal adhesive coating having a low solids content of less than about 40 wt. % solids thereon, said coating being diluted with a petroleum diluent adapted to increase the polarity of said adhesive and having a relatively slow evaporation rate so that the adhesive is applied in a liquid form, conveying said parts to a drying oven for curing, conveying said parts from said oven to a second disc-type electrostatic applicator, applying a second rubber-to-metal adhesive having a low solids content of less than about 40 wt. % solids by said second applicator, said second adhesive being diluted by a petroleum diluent adapted to increase the polarity of said second adhesive and having a relatively slow evaporation rate so that said second adhesive is applied in a liquid form to said parts, and reconveying said parts to said drying oven for drying said second adhesive.

2. The process as defined in claim 1 said first and second low solids content adhesives being diluted with a diluent containing cyclohexanone and petroleum solvents.

3. A process of applying a rubber-to-metal adhesive coating on metal parts comprising the steps of:

diluting a rubber-to-metal adhesive having a low solids contents of less than about 40 wt. % solids with a solvent adapted to increase the polarity of said adhesive, heating said solvent diluted adhesive, and electrostatically applying said diluted adhesive to such metal parts.

4. A process as defined in claim 3 wherein, said adhesive, at room temperature, has a visicosity of between 22 and 26 measured in a No. 2 Zahn cup.

5. A process as defined in claim 3 wherein said step of electrostatical applying comprises applying said diluted adhesive with a rotating disc electrostatic applicator having a 15 inch diameter, said disc rotating at about 1800 r.p.m. with a potential gradient of between 72,000 and 78,000 volts.

6. A process as defined in claim 3 wherein said solvent comprises about 4 parts cyclohexanone, 2 parts SC 150, 2 parts SC 100, and 1 part MEK.

7. A process as defined in claim 6 wherein said solvent is mixed in about equal parts with said adhesive.

* * * * *